US005098650A

United States Patent [19]

Eylon et al.

[11] Patent Number: 5,098,650

[45] Date of Patent: Mar. 24, 1992

[54] METHOD TO PRODUCE IMPROVED PROPERTY TITANIUM ALUMINIDE ARTICLES

[75] Inventors: Daniel Eylon, Dayton; Karen R. Teal, Springfield, both of Ohio

[73] Assignee: The United States of America as represented by the Secretary of the Air Force, Washington, D.C.

[21] Appl. No.: 747,160

[22] Filed: Aug. 16, 1991

[51] Int. Cl.[5] ..... B21F 3/00

[52] U.S. Cl. ..... 419/48; 419/23; 419/49; 419/51

[58] Field of Search ..... 419/48, 23, 49, 51

[56] References Cited

U.S. PATENT DOCUMENTS 4,714,587 12/1987 Eylon et al. ..... 419/29

4,788,035 11/1988 Gigliotti et al. ..... 420/420

4,847,044 7/1989 Ghosh ..... 419/8

4,851,053 7/1989 Froes et al. ..... 148/11.5 F 5,015,533 5/1991 Delagi et al. ..... 419/8

*Primary Examiner*—Stephen J. Lechert, Jr.

*Attorney, Agent, or Firm*—Charles E. Bricker; Donald J. Singer

[57] ABSTRACT

A method for producing titamium alloy articles having a desired microstructure which comprises the steps of:

(a) providing a prealloyed gamma titanium aluminide alloy powder;

(b) filling a suitable die or mold with the powder;

(c) consolidating the powder in the filled mold at a pressure of 30 Ksi or greater and at a temperature of about 70 to 95 percent of the alpha-2+gamma eutectoid temperature of the alloy, in degrees C.

6 Claims, 1 Drawing Sheet

METHOD TO PRODUCE IMPROVED PROPERTY TITANIUM ALUMINIDE ARTICLES

RIGHTS OF THE GOVERNMENT

The invention described herein may be manufactured and used by or for the Government of the United States for all governmental purposes without the payment of any royalty.

BACKGROUND OF THE INVENTION

This invention relates to the processing of titanium alloy articles fabricated by powder metallurgy to improve the microstructure of such articles.

Titanium alloy parts are ideally suited for advanced aerospace systems because of their excellent general corrosion resistance and their unique high specific strength (strength-to-density ratio) at room temperature and at moderately elevated temperatures. Despite these attractive features, the use of titanium alloys in engines and airframes is often limited by cost due, at least in part, to the difficulty associated with forging and machining titanium.

To circumvent the high cost of titanium alloy parts, several methods of making parts to near-net shape have been developed to eliminate or minimize forging and/or machining. These methods include superplastic forming, isothermal forging, diffusion bonding, investment casting and powder metallurgy (PM), each having advantages and disadvantages.

Until relatively recently, the primary motivation for using the powder metallurgy approach for titanium was to reduce cost. In general terms, powder metallurgy involves powder production followed by compaction of the powder to produce a solid article. The small, homogeneous powder particles provide a uniformly fine microstructure in the final product. If the final article is made into a net-shape by the application of processes such as Hot Isostatic Pressing (HIP), a lack of texture can result, thus giving equal properties in all directions. The HIP process has been practiced within a relatively broad temperature range, for example, about 700° to 1200° C. (1300°-2200° F.), depending upon the alloy being treated, and within a relatively broad pressure range, for example, 1 to 30 ksi, generally about 15 ksi.

Recent developments in advanced hypersonic aircraft and propulsion systems require high temperature, low density materials which allow higher strength to weight ratio performance at higher temperatures. As a result, titanium aluminide alloys are now being targeted for many such applications. Titanium aluminide alloys based on the ordered gamma TiAl phase are currently considered to be one of the most promising group of alloys for this purpose. However, the TiAl ordered phase is very brittle at lower temperatures and has low resistance to cracking under cyclic thermal conditions.

It has been recognized for some time that the refinement of the ordered material grain size leads to an improved room temperature ductility. Unfortunately, conventional processing methods, such as ingot metallurgy (IM) or casting, fail to refine the gamma grain structure. An exception to this general rule is the powder metallurgy approach. When atomized into small spheres, prealloyed powder, such as Plasma Rotating Electrode Process (PREP) powder, provides particles with ultrafine gamma grain structure.

Accordingly, it is an object of the present invention to provide a process for producing articles having a desirable fine microstructure by powder metallurgy of gamma titanium aluminide alloys.

Other objects, aspects and advantages of the present invention will be apparent to those skilled in the art after reading the detailed description of the invention as well as the appended claims.

SUMMARY OF THE INVENTION

In accordance with the present invention there is provided a method for producing titanium alloy articles having a desired microstructure which comprises the steps of:

(a) providing a prealloyed gamma titanium aluminide alloy powder;

(b) filling a suitable die or mold with the powder;

(c) hot isostatic press (HIP) consolidating the powder in the filled mold at a pressure of 30 Ksi or greater and at a temperature of about 70 to 95 percent of the alpha-two+gamma eutectoid temperature of the alloy, in degrees C.

DETAILED DESCRIPTION OF THE INVENTION

Figure 1:
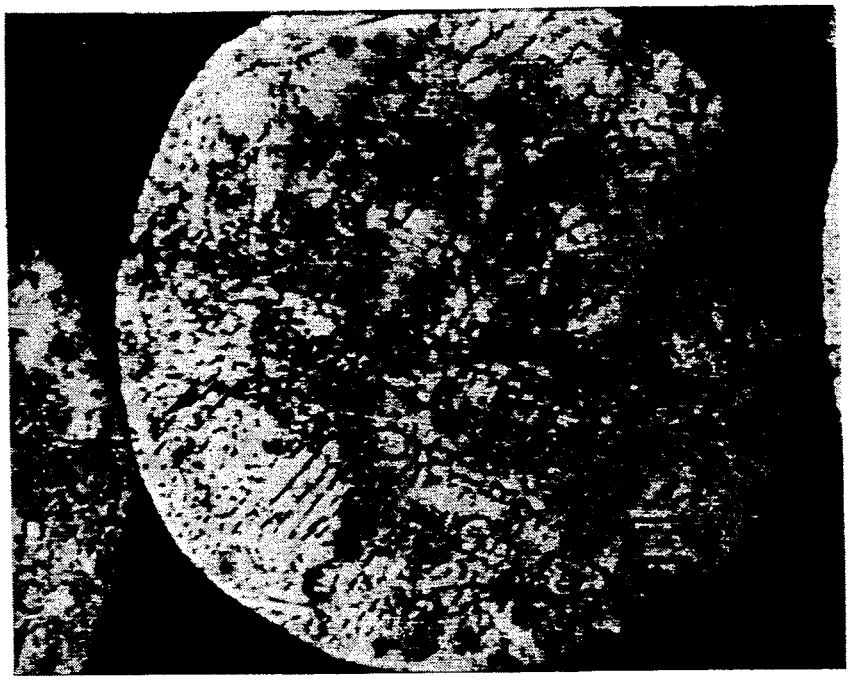
FIG. 1 is a 600x photomicrograph illustrating the microstructure of gamma TiAl alloy powder particles.

The titanium-aluminum alloys suitable for use in the present invention are the gamma alloys containing about 45-55 atomic percent aluminum and about 55-45 atomic percent titanium, and, optionally, modified with about 0.1-5 atomic percent of at least one beta stabilizer selected from the group consisting of Nb, Mo, Mn, Cr, W and V. Examples of titanium-aluminum alloys suitable for use in the present invention include Ti-50Al, Ti-48Al-1Nb, Ti-48Al-2Nb-2Cr, Ti-48Al-1Nb-1V and Ti-48Al-3Nb-2Cr-1Mn (expressed in atomic percent).

For production of high quality, near-net titanium shapes according to the invention, spherical powder free of detrimental foreign particles is desired. In contrast to flake or angular particles, spherical powder flows readily, with minimal bridging tendency, and packs to a consistent tap density (about 65%).

A variety of techniques may be employed to make the titanium alloy powder, including the rotating electrode process (REP) and variants thereof such as melting by plasma arc (PREP) or laser (LREP) or electron beam, electron beam rotating disc (EBRD), powder under vacuum (PSV), gas atomization (GA) and the like. These techniques typically exhibit cooling rates of about 100° to 100,000° C./sec. The powder typically has a diameter of about 25 to 600 microns and, as a result of the high cooling rate, has an ultrafine grain structure.

Production of shapes may be accomplished using a metal can, ceramic mold or fluid die technique. In the metal can technique, a metal can is shaped to the desired configuration by state-of-the-art sheet-metal methods, e.g. brake bending, press forming, spinning, superplastic forming, etc. The most satisfactory container appears to be carbon steel, which reacts minimally with the titanium, forming titanium carbide which then inhibits further reaction. Fairly complex shapes have been produced by this technique.

The ceramic mold shape making process relies basically on the technology developed by the investment casting industry, in that molds are prepared by the lost-wax process. In this process, wax patterns are prepared as shapes intentionally larger than the final configuration. This is necessary since in powder metallurgy a large volume difference occurs in going from the wax pattern (which subsequently becomes the mold) and the consolidated compact. Knowing the desired configuration of the compacted shape, allowances can be made using the packing density of the powder to define the required wax-pattern shape.

The fluid die or rapid omnidirectional consolidation (ROC) process is an outgrowth of work on glass containers. In the current process, dies are machined or cast from a range of carbon steels or made from ceramic materials. The dies are of sufficient mass and dimensions to behave as a viscous liquid under pressure at temperature when contained in an outer, more rigid pot die, if necessary. The fluid dies are typically made in two halves, with inserts where necessary to simplify manufacture. The two halves are then joined together to form a hermetic seal. Powder loading, evacuation and consolidation then follow. The fluid die process is claimed to combine the ruggedness and fabricability of metal with the flow characteristics of glass to generate a replicating container capable of producing extremely complex shapes.

In the metal can and ceramic mold processes, the powder-filled mold is supported in a secondary pressing medium contained in a collapsible vessel, e.g., a welded metal can. Following evacuation and elevated-temperature outgassing, the vessel is sealed, then placed in an autoclave or other apparatus capable of isostatically compressing the vessel.

Consolidation of the titanium alloy powder is accomplished by applying a pressure of at least 30 ksi, preferably at least about 35 ksi, at a temperature of about 70 to 95 percent of the alpha-two + gamma eutectoid temperature of the alloy (in degrees C.) for about 1 to 48 hours in processes such as HIP, or about 0.25 sec. up to about 300 sec. in processes such as ROC and extrusion. It will be recognized by those skilled in the art that the practical maximum applied pressure is limited by the apparatus employed.

Following consolidation, the compacted article is recovered using techniques known in the art. The resulting article is fully dense and has a very fine, uniform and isotropic microstructure.

The following example illustrates the invention.

Prealloyed TiAl PREP -35 mesh spherical alloy powder, with a median particle size of 170 microns was used. The prealloyed powder was compacted at 1700° F. and 42 Ksi for 6 hours. Metallographic samples were prepared at all experimental stages by conventional techniques. Optical microscopy (OM) and scanning electron microscopy (SEM) were utilized in both microstructural and fractographic examination. Differential interference contrast (DIC) was used in examining the microstructure of the as-received powder and the non-hydrogenated specimens. X-ray diffraction (XRD) was conducted on a majority of samples using a diffractometer with $CuK_{60}$ radiation.

Figure 2:
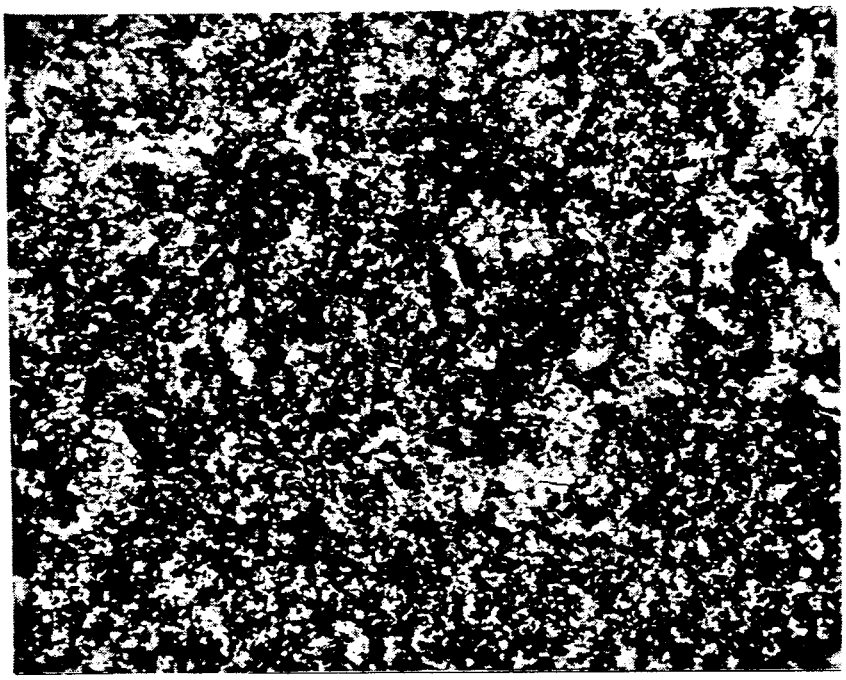
FIG. 2 is a 400x photomicrograph illustrating the microstructure of a gamma TiAl powder compact.

The microstructures of the as-atomized and the as-compacted powder are compared in the high magnification SEM photomicrographs shown in FIGS. 1 and 2 respectively. The as-atomized microstructure is typically an ultrafine gamma structure with some retained alpha-two and alpha, the result of the rapid solidification, with some evidence of dendritic structure developed during solidification. The as-compacted microstructure is a uniform ultrafine equiaxed gamma structure with grain size on the order of 1 to 3 μm.

Various modifications may be made to the invention as described without departing from the spirit of the invention or the scope of the appended claims.

We claim:

1. A method for producing titanium alloy articles having a desired microstructure which comprises the steps of:

(a) providing prealloyed gamma titanium aluminide alloy powder;

(b) filling a suitable die or mold with the powder;

(c) consolidating the powder in the filled mold at a pressure of 30 Ksi or greater and at a temperature of about 70 to 95 percent of the alpha-two + gamma eutectoid temperature of the alloy, in degrees C.

2. The method of claim 1 wherein said titanium aluminide alloy comprises about 0.1–5 atomic percent of at least one beta stabilizer element selected from the group consisting of Nb, Mo, Mn, Cr, W and V.

3. The method of claim 2 wherein said alloy is Ti-48Al-lNb.

4. The method of claim 2 wherein said alloy is Ti-48Al-2Nb-2Cr.

5. The method of claim 2 wherein said alloy is Ti-48Al-lNb-lV.

6. The method of claim 2 wherein said alloy is Ti-48Al-3Nb-2Cr-lMn.

* * * * *

UNITED STATES PATENT AND TRADEMARK OFFICE

CERTIFICATE OF CORRECTION

PATENT NO. : 5,098,650

DATED : March 24, 1992

INVENTOR(S) : Daniel Eylon et al

It is certified that error appears in the above-identified patent and that said Letters Patent is hereby corrected as shown below:

Column 4, line 14, "$CuK_{60}$" should read --$CuK_{\alpha}$--.

Column 4, line 17, a comma should follow "2"

Signed and Sealed this

Fifteenth Day of June, 1993

*Attest:*

*Attesting Officer*

Michael K. Kirk

MICHAEL K. KIRK

*Acting Commissioner of Patents and Trademarks*